US009149070B2

(12) United States Patent
Sebastian et al.

(10) Patent No.: US 9,149,070 B2
(45) Date of Patent: Oct. 6, 2015

(54) SEGMENTED CIGARETTE FILTER FOR SELECTIVE SMOKE FILTRATION

(75) Inventors: Andries D. Sebastian, Clemmons, NC (US); Stephen Benson Sears, Siler City, NC (US); Anthony Richard Gerardi, Winston-Salem, NC (US)

(73) Assignee: R.J. Reynolds Tobacco Company, Winstron-Salem, NC (US)

( * ) Notice: Subject to any disclaimer, the term of this patent is extended or adjusted under 35 U.S.C. 154(b) by 1086 days.

(21) Appl. No.: 13/182,948

(22) Filed: Jul. 14, 2011

(65) Prior Publication Data

US 2013/0014774 A1 Jan. 17, 2013

(51) Int. Cl.

| | |
|---|---|
| ***A24D 3/10*** | (2006.01) |
| ***A24D 3/06*** | (2006.01) |
| ***A24D 3/14*** | (2006.01) |

(52) U.S. Cl.

CPC *A24D 3/068* (2013.01); *A24D 3/10* (2013.01); *A24D 3/14* (2013.01); *Y10T 428/2964* (2015.01); *Y10T 428/2965* (2015.01); *Y10T 428/2967* (2015.01); *Y10T 428/2969* (2015.01)

(58) Field of Classification Search

CPC ..... A24D 3/068
USPC ..... 131/331, 332
See application file for complete search history.

(56) References Cited

U.S. PATENT DOCUMENTS

| | | | |
|---|---|---|---|
| 2,794,239 | A | 6/1957 | Crawford et al. |
| 2,953,838 | A | 9/1960 | Crawford et al. |
| 3,424,172 | A | 1/1969 | Neurath et al. |
| 4,105,569 | A | 8/1978 | Crossfield |
| 4,179,544 | A | 12/1979 | Newkirk et al. |
| 4,281,671 | A | 8/1981 | Bynre et al. |
| 4,714,082 | A | 12/1987 | Banerjee et al. |
| 4,756,318 | A | 7/1988 | Clearman et al. |
| 4,771,795 | A | 9/1988 | White et al. |
| 4,793,365 | A | 12/1988 | Sensabaugh, Jr. et al. |
| 4,807,809 | A | 2/1989 | Pryor et al. |
| 4,810,474 | A | 3/1989 | Liu et al. |

(Continued)

FOREIGN PATENT DOCUMENTS

| | | | |
|---|---|---|---|
| WO | WO 2006/064371 | A1 | 6/2006 |
| WO | WO 2009/143338 | A2 | 11/2009 |

OTHER PUBLICATIONS

U.S. Appl. No. 12/827,618.

(Continued)

*Primary Examiner* — Yogendra Gupta
*Assistant Examiner* — Kimberly A Stewart
(74) *Attorney, Agent, or Firm* — Brinks Gilson & Lione

(57) ABSTRACT

A filter material of a filter element configured for application in a smoking article may include a fibrous substrate material finished with a fiber finish composition. The fiber finish composition may be formulated to selectively interact with at least one target component of mainstream smoke drawn through the filter element during use of the smoking article to selectively filter the target component from the smoke. The filter element may include multiple filter segments. Each filter segment may include a filter material having a finish composition formulated to selectively interact with a different target component. The various filter segments may be combined and/or arranged to selectively filter the mainstream smoke to achieve desired characteristics. Each filter segment may be formed from the same fibrous substrate material.

9 Claims, 1 Drawing Sheet

(56) References Cited

U.S. PATENT DOCUMENTS

| | | | | |
|---|---|---|---|---|
| 4,811,745 | A | | 3/1989 | Cohen et al. |
| 4,862,905 | A | | 9/1989 | Green, Jr. et al. |
| 4,892,719 | A | | 1/1990 | Gesser |
| 4,917,128 | A | | 4/1990 | Clearman et al. |
| 4,925,602 | A | | 5/1990 | Hill et al. |
| 4,961,438 | A | | 10/1990 | Korte |
| 4,966,171 | A | | 10/1990 | Serrano et al. |
| 4,969,476 | A | | 11/1990 | Bale et al. |
| 4,989,619 | A | | 2/1991 | Clearman et al. |
| 4,991,606 | A | | 2/1991 | Serrano et al. |
| 5,020,548 | A | | 6/1991 | Farrier et al. |
| 5,027,836 | A | | 7/1991 | Shannon et al. |
| 5,033,483 | A | | 7/1991 | Clearman et al. |
| 5,040,551 | A | | 8/1991 | Schlatter et al. |
| 5,050,621 | A | | 9/1991 | Creighton et al. |
| 5,052,413 | A | | 10/1991 | Baker et al. |
| 5,060,664 | A | | 10/1991 | Siems et al. |
| 5,065,776 | A | | 11/1991 | Lawson et al. |
| 5,076,296 | A | | 12/1991 | Nystrom et al. |
| 5,076,297 | A | | 12/1991 | Farrier et al. |
| 5,099,861 | A | | 3/1992 | Clearman et al. |
| 5,101,839 | A | | 4/1992 | Jakob et al. |
| 5,105,835 | A | | 4/1992 | Drewett et al. |
| 5,105,837 | A | | 4/1992 | Barnes et al. |
| 5,115,820 | A | | 5/1992 | Hauser et al. |
| 5,148,821 | A | | 9/1992 | Best et al. |
| 5,159,940 | A | | 11/1992 | Hayward et al. |
| 5,159,944 | A | | 11/1992 | Arzonico et al. |
| 5,178,167 | A | | 1/1993 | Riggs et al. |
| 5,183,062 | A | | 2/1993 | Clearman et al. |
| 5,211,684 | A | | 5/1993 | Shannon et al. |
| 5,220,930 | A | | 6/1993 | Gentry |
| 5,225,277 | A | | 7/1993 | Takegawa et al. |
| 5,240,014 | A | | 8/1993 | Deevi et al. |
| 5,240,016 | A | | 8/1993 | Nichols et al. |
| 5,271,419 | A | | 12/1993 | Arzonico et al. |
| 5,345,955 | A | | 9/1994 | Clearman et al. |
| 5,387,285 | A | | 2/1995 | Rivers |
| 5,396,911 | A | | 3/1995 | Casey, III et al. |
| 5,465,739 | A | * | 11/1995 | Perfetti et al. ..... 131/335 |
| 5,551,451 | A | | 9/1996 | Riggs et al. |
| 5,568,819 | A | | 10/1996 | Gentry et al. |
| 5,595,577 | A | | 1/1997 | Bensalem et al. |
| 5,665,126 | A | | 9/1997 | Patil et al. |
| 5,709,227 | A | * | 1/1998 | Arzonico et al. ..... 131/341 |
| 5,727,571 | A | | 3/1998 | Meiring et al. |
| 5,819,751 | A | | 10/1998 | Barnes et al. |
| 6,089,857 | A | | 7/2000 | Matsuura et al. |
| 6,095,152 | A | | 8/2000 | Beven et al. |
| 6,344,239 | B1 | * | 2/2002 | Asai et al. ..... 427/212 |
| 6,526,739 | B2 | | 3/2003 | Kutsenko et al. |
| 6,537,186 | B1 | | 3/2003 | Veluz |
| 6,537,662 | B1 | | 3/2003 | Kamrath et al. |
| 6,578,584 | B1 | | 6/2003 | Beven et al. |
| 6,779,530 | B2 | | 8/2004 | Kraker |
| 7,074,170 | B2 | | 7/2006 | Lanier, Jr. et al. |
| 7,234,471 | B2 | | 6/2007 | Fitzgerald et al. |
| 7,237,559 | B2 | | 7/2007 | Ashcraft et al. |
| 7,503,330 | B2 | | 3/2009 | Borschke et al. |
| 7,565,818 | B2 | | 7/2009 | Thomas et al. |
| 7,816,483 | B2 | | 10/2010 | Hogan et al. |
| 2005/0066984 | A1 | * | 3/2005 | Crooks et al. ..... 131/341 |
| 2005/0066986 | A1 | | 3/2005 | Nestor et al. |
| 2005/0215799 | A1 | | 9/2005 | Wentland et al. |
| 2005/0287368 | A1 | | 12/2005 | Corallo et al. |
| 2006/0289023 | A1 | * | 12/2006 | Von Borstel ..... 131/334 |
| 2007/0056600 | A1 | | 3/2007 | Coleman, III et al. |
| 2007/0246055 | A1 | | 10/2007 | Oglesby |
| 2008/0135058 | A1 | * | 6/2008 | Germroth et al. ..... 131/202 |
| 2008/0245376 | A1 | | 10/2008 | Travers et al. |
| 2011/0180084 | A1 | | 7/2011 | Sebastian et al. |
| 2012/0000480 | A1 | * | 1/2012 | Sebastian et al. ..... 131/332 |

OTHER PUBLICATIONS

U.S. Appl. No. 12/859,494.
U.S. Appl. No. 12/917,171.
U.S. Appl. No. 12/963,275.
International Search Report and Written Opinion of the International Searching Authority for International Application No. PCT/US2012/040860, dated Oct. 30, 2012, 6 pages.

* cited by examiner

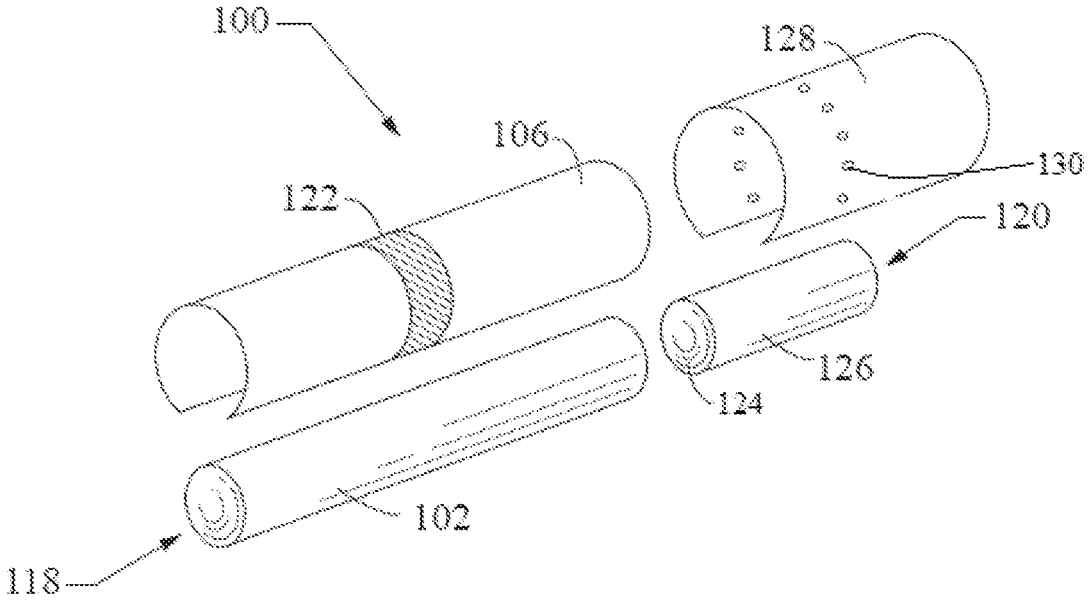
100
128
106
130
122
120
126
124
102
118

SEGMENTED CIGARETTE FILTER FOR SELECTIVE SMOKE FILTRATION

TECHNICAL FIELD

The present invention relates to products made or derived from tobacco, or that otherwise incorporate tobacco, and are intended for human consumption. More particularly, the invention pertains to components and configurations of segmented-type filters for smoking articles such as cigarettes.

BACKGROUND

Popular smoking articles, such as cigarettes, have a substantially cylindrical rod-shaped structure and include a charge, roll or column of smokable material, such as shredded tobacco (e.g., in cut filler form), surrounded by a paper wrapper, thereby forming a so-called "smokable rod" or "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." A cigarette may incorporate a filter element having multiple segments, and one of those segments may comprise activated charcoal particles. See, for example, U.S. Pat. No. 6,537,186 to Veluz; U.S. Pat. App. Pub. No. 2007/0056600 to Coleman III, et al.; and PCT Pub. No. WO 2006/064371 to Banerjea; each of which is incorporated herein by reference. Typically, the filter element is attached to one end of the tobacco rod using a circumscribing wrapping material known as "tipping paper." It also has become desirable to perforate the tipping material and plug wrap to provide dilution of drawn mainstream smoke with ambient air. Descriptions of cigarettes and the various components thereof are set forth in Tobacco Production, Chemistry and Technology, Davis et al. (Eds.) (1999) and U.S. Pat. No. 7,503,330 to Borschke et al, which is incorporated herein by reference.

A cigarette is employed by a smoker by lighting one end thereof and burning the tobacco rod. The smoker then receives mainstream smoke into his/her mouth by drawing on the opposite end (e.g., the filter end) of the cigarette, until the tobacco rod is partially or completely consumed, after which the remaining cigarette portion is discarded.

The discarded portion of the cigarette rod typically is primarily composed of the filter element, although it may include most or all of a tobacco rod. In general, cigarette filters include solvent cross linked cellulose acetate fiber bundles wrapped in two layers of paper. The first layer of paper, often referred to as plug wrap, holds the fiber bundle together in a rod form and may include a glue line to anchor the fiber bundle to the plug wrap paper; the second layer, often referred to as the tipping, is fully adhered to the plug wrap and attaches the filter tube to the wrapping material surrounding the cigarette's tobacco rod. Cigarette filters may be slow to degrade or disperse in some environments. This is generally attributed to the tightly bound nature of the filter plug's design which is configured to provide a specified filtering effect, but which may insulate the majority of the filter from certain environmental effects upon disposal.

The most commonly used polymer in cigarette filter manufacture is cellulose acetate that has a degree of acetate substitution of about 2.5 acetate groups per anhydroglucose unit group. During manufacture, the acetate polymer typically is extruded as a fiber tow, and mixed with one or more plasticizers (e.g., triacetin, polyethylene glycol, glycerin). Cellulose acetate tow processes are set forth, for example, in U.S. Pat. No. 2,953,838 to Crawford et al. and U.S. Pat. No. 2,794, 239 to Crawford et al., which are incorporated herein by reference. Various fluids may be injected and distributed to the multifilament fiber tow used in the manufacture of tobacco smoke filters. These fluids, which may be injected and distributed into the tow alone or in combination with liquid or gaseous carriers, may be flavorants, tow blooming agents, lubricants, sizing solutions, finish compositions, plasticizers, or the like. Such fluids are intended to impart desired physical or flavor characteristics to the fluid-treated tow. Fluid injection processes are set forth, for example, in U.S. Pat. No. 5,387,285 to Rivers, which is incorporated herein by reference.

The cellulose acetate fibers that form the filter element typically are coated with a fiber finish composition. Such compositions are generally water based emulsions comprising multiple components. Each component may serve a specific function either during processing of the fibers or during subsequent use of a filter formed from the fibers. Typical components of a fiber finish composition include lubricating oils to reduce friction so that the fibers can be processed without breakage, anti-static agents to reduce static build-up on the fibers, and emulsifiers to inhibit phase separation in a fiber formulation during processing. Other auxiliary components may include anti-microbial agents, hydrophilic agents, or other reactive compounds. After assembly of fibrous tow into filter-ready material, plasticizers may be applied to soften the fiber and to enable inter-fiber bonds to form to harden the filter to a desired hardness/consistency. The surface chemistry of cellulose acetate and plasticizer may provide for a smoke flavor that is widely desired and accepted by smokers. This may be due in part to the well-known ability of cellulose acetate and plasticizer to reduce naturally occurring phenolic compounds from tobacco smoke. Certain other filter designs/formulations may provide a different smoke flavor. To date, non-cellulose acetate tow filters have not generally been accepted nor met with commercial success.

It would be highly desirable to provide a smoker with an enhanced smoking experience, such as can be accomplished by providing a filtered cigarette including a filter element having particular design features. To that end, it would be desirable to provide a filter element for a cigarette that is capable of selectively filtering various components of the mainstream smoke produced during use of the cigarette. It may be desirable to formulate the fiber finish composition employed in a particular filter segment to provide a desired surface chemistry for selective vapor phase compound removal. It may be desirable to provide a filter element including multiple filter segments, each having a surface chemistry formulated to selectively interact with specific vapor phase compounds.

BRIEF SUMMARY

Embodiments of the present invention relate to smoking articles, and in particular, to rod-shaped smoking articles, such as cigarettes. A smoking article includes a lighting end (i.e., an upstream end) and a mouth end (i.e., a downstream end). The smoking article also includes a filter element disposed at the mouth end of the smoking article and including at least one filter segment. The filter element may be configured as a multi-segmented filter element having at least two filter segments. Multiple filter segments may be arranged in an end-to-end relationship with one another. Alternatively, multiple filter segments may be arranged in a concentric relationship with one another. Each filter segment may include a filter material including a fibrous substrate material including a finish composition. The finish composition may be formulated to selectively interact with at least one target component of mainstream aerosol (i.e., mainstream smoke) drawn through the filter element by the smoker. The target component may be a vapor phase compound and/or particulate matter. Different filter segments may include different finish compositions to selectively interact with different target components of the mainstream smoke. The various filter segments may be combined and/or arranged to selectively filter the mainstream smoke to achieve desired characteristics.

BRIEF DESCRIPTION OF THE DRAWING

The FIGURE is an embodiment of a smoking article.

DETAILED DESCRIPTION

Embodiments are described with reference to the drawing. The relationship and functioning of the various elements of the embodiments may better be understood by reference to the following detailed description. However, embodiments are not limited to those illustrated in the drawing. It should be understood that the drawing is not necessarily to scale, and in certain instances details may have been omitted that are not necessary for an understanding of embodiments of the present invention, such as—for example—conventional fabrication and assembly. As used in this specification and the claims, the singular forms "a," "an," and "the" include plural referents unless the context clearly dictates otherwise. As used herein, "fiber" is intended to include continuous and non-continuous or staple fibers (including for example monofilament fibers, fiber/fibrous tow, braided fibers, spun fibers, wound fibers, mono-component fibers, bi-component fibers, multi-component fibers, etc.), and each reference to any type of fiber should be considered generic except for those cases where one of skill in the art would recognize that the context is technically limited to a single fiber type.

As shown in the FIGURE, a smoking article 100 may be embodied as a cigarette. The cigarette 100 may include a generally cylindrical rod 102 of a charge or roll of smokable filler material contained in a circumscribing wrapping material 106. The rod 102 is conventionally referred to as a "tobacco rod." The ends of the tobacco rod 102 may be open to expose the smokable filler material. The cigarette 100 may include a band 122 (e.g., a printed coating including a film-forming agent, such as starch, ethylcellulose, or sodium alginate) applied to the wrapping material 106, and that band may circumscribe the cigarette rod in a direction transverse to the longitudinal axis of the cigarette. That is, the band 122 may provide a cross-directional region relative to the longitudinal axis of the cigarette. The band 122 may be printed on the inner surface of the wrapping material (i.e., facing the smokable filler material), or less preferably, on the outer surface of the wrapping material. Although the cigarette may possess a wrapping material having one band, the cigarette also may possess wrapping material having further spaced bands numbering two, three, or more, which bands may be configured to inhibit the ignition propensity and/or ability of the cigarette to remain lit if not in active use.

A filter element 120 may be disposed at the mouth end of the tobacco rod 102, and the lighting end 118 is positioned at the opposite end. The filter element 120 may be axially aligned in an end-to-end relationship with and preferably abutting the tobacco rod 102. The filter element 120 may have a generally cylindrical shape, and its diameter may be substantially the same as the diameter of the tobacco rod. The proximal and distal ends of the filter element 120 may permit the passage of air and smoke therethrough.

The filter element 120 may include a filter material 124 (e.g., starch-based, polypropylene, or plasticized cellulose acetate tow) circumscribed by a plug wrap 126. The filter material also may have the form of a gathered web (e.g., polypropylene web, polyester web, or starch-based web), which is gathered using techniques such as those described in U.S. Pat. No. 4,870,809 to Pryor et al. If desired, the filter material may have at least one tubular capillary, passage, or groove (not shown) extending longitudinally therethrough or partially therethrough. The plug wrap may be a paper which incorporates a carbonaceous material. The plug wrap 126 may circumscribe the total length of the filter element 120.

The filter element 120 may be attached to the tobacco rod 102 by a tipping material 128 which circumscribes both the entire length of the filter element 120 and an adjacent region of the tobacco rod 102. The inner surface of the tipping material 128 may be fixedly secured to the outer surface of the plug wrap 126 and the outer surface of the wrapping material 106 of the tobacco rod, using a suitable adhesive.

A ventilated or air diluted smoking article may be provided with an optional air dilution means, such as a series of perforations 130, each of which extend through the tipping material 128 and plug wrap 126. The optional perforations 130, shown in the figure, may be made by various techniques known to those of ordinary skill in the art, such as laser perforation techniques. Alternatively, so-called off-line air dilution techniques can be used (e.g., through the use of porous paper plug wrap and pre-perforated tipping paper). For cigarettes that are air diluted or ventilated, the amount or degree of air dilution or ventilation may vary. Frequently, the amount of air dilution for an air diluted cigarette may be greater than about 10 percent, generally may be greater than about 20 percent, and sometimes is greater than about 40 percent. The upper level for air dilution for an air diluted cigarette may be less than about 80 percent, and often is less than about 70 percent. As used herein, the term "air dilution" is the ratio (expressed as a percentage) of the volume of air drawn through the air dilution means to the total volume and air and smoke drawn through the cigarette and exiting the extreme mouth end portion of the cigarette.

During use, the smoker typically lights the lighting end 118 of the cigarette 100 using a match or cigarette lighter, whereupon the smokable material 102 begins to burn. The mouth end of the cigarette 100 is placed in the lips of the smoker. Thermal decomposition products (e.g., components of tobacco aerosol or smoke) generated by the burning smokable material 102 are drawn through the cigarette 100, through the filter element 120, and into the mouth of the smoker. Following use of the cigarette 100, the filter element 120 and any residual portion of the tobacco rod 102 may be discarded.

The dimensions of a representative cigarette 100 may vary. Preferred cigarettes may be rod-shaped having diameters of about 7.5 mm (e.g., circumferences of about 20 mm to about 27 mm, often about 22.5 mm to about 25 mm); and may have total lengths of about 70 mm to about 120 mm, often about 80 mm to about 100 mm. The length of the filter element 30 may vary. Typical filter elements may have total lengths of about 15 mm to about 40 mm, often about 20 mm to about 35 mm. For a typical dual-segment filter element, the downstream or mouth end filter segment often may have a length of about 10 mm to about 20 mm; and the upstream or tobacco rod end filter segment often may have a length of about 10 mm to about 20 mm.

Various types of cigarette components, including tobacco types, tobacco blends, top dressing and casing materials, blend packing densities and types of paper wrapping materials for tobacco rods may be employed. See, for example, the various representative types of cigarette components, as well as the various cigarette designs, formats, configurations and characteristics, that are set forth in Johnson, Development of Cigarette Components to Meet Industry Needs, 52nd T.S.R.C. (September 1998); U.S. Pat. No. 5,101,839 to Jakob et al.; U.S. Pat. No. 5,159,944 to Arzonico et al.; U.S. Pat. No. 5,220,930 to Gentry and U.S. Pat. No. 6,779,530 to Kraker; U.S. Pat. No. 7,237,559 to Ashcraft et al.; U.S. Pat. No. 7,234,471 to Fitzgerald et al.; and U.S. Pat. No. 7,565,818 to Thomas et al.; and U.S. Pat. Pub. Nos. 2005/0066986 to Nestor et al.; 2007/0056600 to Coleman, III et al.; and 2007/0246055 to Oglesby, each of which is incorporated herein by reference. The entire smokable rod may be composed of smokable material (e.g., tobacco cut filler) and a layer of circumscribing outer wrapping material.

Filter material may vary, and may be any material of the type that may be employed for providing a tobacco smoke filter for cigarettes. Traditional cigarette filter material may be used, such as cellulose acetate tow, gathered cellulose acetate web, polypropylene tow, gathered cellulose acetate web, gathered paper, strands of reconstituted tobacco, or the like. One filter material that may provide a suitable filter rod is cellulose acetate tow having 3 denier per filament and 40,000 total denier. As another example, cellulose acetate tow having 3 denier per filament and 35,000 total denier may provide a suitable filter rod. As another example, cellulose acetate tow having 8 denier per filament and 40,000 total denier may provide a suitable filter rod. For further examples, see the types of filter materials set forth in U.S. Pat. No. 3,424,172 to Neurath; U.S. Pat. No. 4,811,745 to Cohen et al.; U.S. Pat. No. 4,925,602 to Hill et al.; U.S. Pat. No. 5,225,277 to Takegawa et al. and U.S. Pat. No. 5,271,419 to Arzonico et al.; each of which is incorporated herein by reference.

Normally, a plasticizer such as triacetin or carbowax may be applied to the filamentary tow in traditional amounts using known techniques. In one embodiment, the plasticizer component of the filter material may include triacetin and carbowax in a 1:1 ratio by weight. The total amount of plasticizer generally may be about 4 to about 20 percent by weight, preferably about 6 to about 12 percent by weight. Other suitable materials or additives used in connection with the construction of the filter element will be readily apparent to those skilled in the art of cigarette filter design and manufacture. See, for example, U.S. Pat. No. 5,387,285 to Rivers, which is incorporated herein by reference.

Filamentary tow, such as cellulose acetate, may be processed using a conventional filter tow processing unit such as a commercially available E-60 supplied by Arjay Equipment Corp., Winston-Salem, N.C. Other types of commercially available tow processing equipment, as are known to those of ordinary skill in the art, similarly may be used.

The filter elements disclosed herein may include a plurality of longitudinally-extending filter segments. Each filter segment may have varying properties and may include various materials capable of filtration and/or adsorption of particulate matter and/or vapor phase compounds. Typically, a filter element of the invention may include 1 to 6 segments, and frequently may include 2 to 4 segments. One or more of the segments may include one or more of the biodegradable and/or otherwise degradable components discussed herein, and may be coated with cellulose acetate.

A process for making cellulose acetate filter elements typically may begin with forming cellulose fibers. The first step in conventional cellulose acetate fiber formation is esterifying a cellulose material. Cellulose is a polymer formed of repeating units of anhydroglucose. Each monomer unit has three hydroxyl groups available for ester substitution (e.g., acetate substitution). Cellulose esters may be formed by reacting cellulose with an acid anhydride. To make cellulose acetate, the acid anhydride is acetic anhydride. Cellulose pulp from wood or cotton fibers typically may be mixed with acetic anhydride and acetic acid in the presence of an acid catalyst such as sulfuric acid. The esterification process of cellulose often may result in essentially complete conversion of the available hydroxyl groups to ester groups (e.g., an average of about 2.9 ester groups per anhydroglucose unit). Following esterification, the polymer typically may be hydrolyzed to drop the degree of substitution (DS) to about 2 to about 2.5 ester groups per anhydroglucose unit. The resulting product typically may be produced in flake form that may be used in subsequent processing.

To form a fibrous material, the cellulose acetate flake typically may be dissolved in a solvent (e.g., acetone, methanol, methylene chloride, or mixtures thereof) to form a viscous solution. The concentration of cellulose acetate in the solution typically may be about 15 to about 35 percent by weight. Additives such as whitening agents (e.g., titanium dioxide) may be added to the solution if desired. The resulting liquid is sometimes referred to as a liquid "dope." The cellulose acetate dope may be spun into filaments using a solution-spinning technique, which may entail extruding the liquid dope through a spinerette. A finish composition may be applied to the cellulose acetate filaments during this process. Application of the finish composition typically may take place as the filaments exit the spinerette. The finish composition may be applied by any known or developed process such as, for example, direct liquid application using rolls or lube tips or spray application using a spray system. Exemplary processes for applying a finish composition are described in, for example, U.S. Pat. No. 6,526,739 to Kutsenko et al. and U.S. Pat. No. 6,537,662 to Kamrath et al., which are incorporated herein by reference. The filaments may pass through a curing/drying chamber to solidify the filaments prior to collection. The collected fibers may be combined into a tow band, crimped, and dried. Conventional crimp ratios may be in the range of 1.2 to 1.8. The fibers typically may be packaged in bales that may be suitable for later use in filter element formation processes.

As known in the textile arts and used herein, the terms finish, fiber finish, filament finish, yarn finish, and/or spin finish may be used interchangeably with the term finish composition and/or one another. Finish compositions generally may be formulated as multicomponent mixtures of ingredients carried in a liquid base and may be applied to fibers, filaments, and/or yarns for a number of purposes. A finish composition may be applied to filaments to facilitate processing. The finish composition also may be applied to alter the physical and/or chemical properties of the finished filaments. For example, a finish composition may be applied to cellulose acetate filaments that may be incorporated into a cellulose acetate tow for use in a filter element. Such application may alter the physical and/or chemical properties of the filaments, and thus the physical and/or chemical properties of the filter element. Examples of fiber finish compositions are described in U.S. Pat. No. 4,105,569 to Crossfield and U.S. Pat. No. 4,179,544 to Newkirk et al.; and U.S. Pat. App. Pub. No. 2005/0287368 to Corallo et al., which are incorporated herein by reference.

Synthetic filaments without a finish surface coating often may be unsuitable for processing at high speeds, may be prone to break during processing, may develop static charges, and often may exhibit undesirably high friction levels across machinery guides and the like. Thus, a plethora of ingredients routinely may be admixed and applied to filament surfaces.

Antistatic agents, lubricants, emulsifiers, and thickening agents, among others, usually may be included in finish compositions.

A finish composition having a lubricant component may protect a filament from fusion or breakage by controlling the filament to metal friction between the filament and various processing equipment such as, for example, machine guides, rollers, draw plates, heater plates, and texturing false twist spindles or friction disks. Additionally, the lubricant may protect machine surfaces from wear. The lubricant finish composition also may provide for filament cohesion to strengthen the filament by holding the filament bundle together and by allowing the filament to build up an acceptable package at the end of processing. Lubricant finish compositions may be water soluble or water insoluble. Water insoluble components that may be suitable for use as lubricant finish compositions may include, for example, esters, alkanolamides, mineral oils, long chain fatty acids or alcohols, fluorocarbons, and silicones. Suitable water soluble components may include, for example, an ethylene oxide-propylene oxide copolymer.

Static electricity that may be formed as the filament rapidly moves through the processing equipment also may be controlled using a finish composition having an antistatic agent. Finish composition components that may be suitable for use as antistatic agents may include, for example, anionic components such as phosphate alcohols, cationic components such as quaternary amines, nonionic components such as betaines and amine oxides, or amphoteric components.

A finish composition also may include an emulsifier component. Such an emulsifier component may be desirable particularly when a lubricant component of the finish composition is water insoluble and the finish composition is to be applied to a filament as an oil-in-water emulsion. In such a situation, the emulsifier component may help to stabilize the emulsion for effective application of the finish composition to the filaments. Suitable emulsifier components may include, for example, ethoxylated glycerides, ethoxylated fatty acids, ethoxylated fatty alcohols, and polyglycol esters.

Auxiliary agents such as, for example, antioxidants, bactericides, friction modifiers, and/or buffering agents also may be included. For example, antimicrobial compounds that may be available, particularly for aqueous systems, may be included in a fiber finish to control the growth of bacteria, yeast, and/or fungi. In certain embodiments, particularly useful in forming fibrous materials for cigarette filters, a finish composition may include one or more auxiliary agents that may engage in specific types of reactions during use of the filament. For example, at least one auxiliary agent of the finish composition applied to the filaments used to form a cellulose acetate tow may be formulated to selectively interact with at least one specific component of mainstream smoke produced by a smoking article having a filter including the cellulose acetate tow.

In one example, an auxiliary agent may be included in the fiber finish composition to selectively interact with carbonyl compounds such as, for example, low levels of aldehydes and/or ketones that may be present in mainstream smoke generated by the smoking article. More specifically, the auxiliary agent may sequester such carbonyl compounds that may be present as vapor phase components of the mainstream smoke. In this manner, the auxiliary agent may enable a filter element of the smoking article to selectively reduce the concentration of such carbonyl compounds in the mainstream smoke passing through the filter element. In other words, the auxiliary agent may enable the filter element to filter such carbonyl compounds from the mainstream smoke. A cationic polymer having primary amino groups may be a suitable auxiliary agent for such a selective interaction with carbonyl compounds. One example of a suitable cationic polymer may be a poly(allyl amine). Other examples of suitable polymers may include the amine functionalized polymers described in U.S. Pat. No. 7,816,483 to Hogan et al., which is incorporated herein by reference.

In another example, an auxiliary agent may be included in the fiber finish composition to selectively interact with diene compounds such as, for example, isoprene, 1,3-butadiene, or cyclopentadiene that may be present in mainstream smoke generated by the smoking article. A dienophile such as, for example, quinone or a polymer having a functionalized quinone group may be a suitable auxiliary agent for such a selective interaction with diene compounds. Examples of suitable polymers may include those described in U.S. Pat. No. 5,665,126 to Patil et al., which is incorporated herein by reference. The auxiliary agent may form a chemical trap to selectively remove at least a portion of the diene compounds from, and thus effectively reduce the concentration of diene compounds in, the mainstream smoke passing through a filter element. The chemical trap may function by way of, for example, a Diels-Alder reaction. Such a reaction may occur in Lewis Acid conditions. For example, a dienophile present in the finish composition may engage in a reaction, such as a cycloaddition reaction, with a diene compound present in the mainstream smoke to form a stable product, such as a substituted cyclohexene compound. The reaction may occur in the presence of protons that may be present in the mainstream smoke to act as electron acceptors. The stable product may be trapped on the filter element, thus reducing the concentration of the diene compound in the mainstream smoking passing therethrough.

In yet another example, an auxiliary agent may be included in the fiber finish composition to selectively interact with hydroxy-benzene compounds that may be present in mainstream smoke generated by the smoking article. A low molecular weight polymeric or oligomeric diene may be a suitable auxiliary agent for such a selective interaction with hydroxy-benzenes. The interaction may be in the form of a Diels-Alder reaction as described above with reference to selective interaction with diene compounds.

In still another example, an auxiliary agent may be included in the fiber finish composition to selectively interact with hydrocarbons such as, for example, non-polar gases, particularly those other than dienes, that may be present in mainstream smoke generated by the smoking article. A polymer functionalized with a non-polar residue such as, for example, an aliphatic alkane or alkene or an aromatic group such as, for example, benzene or styrene may be a suitable auxiliary agent for such a selective interaction with such hydrocarbons. One example of a suitable polymer having a high non-polar character may be poly(dimethylsiloxane). The selective interaction may take the form of a Van der Waals type interaction. For example, Van der Waals forces between such a functionalized polymer present in a filter element and such a hydrocarbon present in mainstream smoke may significantly increase a resistance to mass transfer of the hydrocarbon through the filter element. Thus, the concentration of the hydrocarbon that may pass entirely through the filter element to reach the mouth of the smoker may be reduced. Such an auxiliary agent also may be capable of selective interaction with phenols, benzene, styrene, and/or toluene that may be present as gas phase components of mainstream smoke.

In another example, an auxiliary agent may be included in the fiber finish composition to selectively interact with nitrogen oxide (e.g., NO and $NO_x$) that may be present in mainstream smoke generated by the smoking article. A transition metal may be capable of interacting with the nitrogen oxide. Such an interaction may be in the form of a chemical reaction to produce a nitrosyl complex. However, the functionality of a transition metal may be inhibited to some degree when the transition metal is bound or complexed to a polymer, as may be desirable for incorporating such a metal into a finish composition. A polymer having at least one moiety such as a dithiocarbamate also may be capable of interacting with the nitrogen oxide. One example of a dithiocarbamate commonly used to detect the presence of nitrogen oxide in or remove nitrogen oxide from gas streams is iron-dithiocarbamate. Examples of other suitable compounds that may be capable of selectively interacting with nitrogen oxide may include those described in U.S. Pat. No. 4,810,474 to Liu et al., which is incorporated herein by reference.

The process of forming the actual filter element typically may involve mechanically withdrawing the cellulose acetate tow, which may include filaments finished with one or more of the finish compositions discussed above, from the bale and separating the fibers into a ribbon-like band. The tow band may be subjected to a "blooming" process wherein the tow band may be separated into individual fibers. Blooming may be accomplished, for example, by applying different tensions to adjacent sections of the tow band or applying pneumatic pressure. The bloomed tow band then may pass through a relaxation zone to allow the fibers to contract, followed by passage into a bonding station. The bonding station typically may apply a plasticizer such as triacetin to the bloomed fibers to soften the fibers and to allow adjacent fibers to fuse together. The bonding process may form a homogenous mass of fibers with increased rigidity. The bonded tow then may be wrapped in plug wrap and cut into filter rods. Cellulose acetate tow processes are set forth, for example, in U.S. Pat. Nos. 2,953,838 to Crawford et al. and U.S. Pat. No. 2,794,239 to Crawford et al., which are incorporated herein by reference.

Filter element components or segments for filter elements for multi-segment filtered cigarettes typically may be provided from filter rods produced using traditional types of rod-forming units, such as those available as KDF-2 and KDF-3E from Hauni-Werke Korber & Co. KG. Typically, filter material such as filter tow may be provided using a tow processing unit. An exemplary tow processing unit has been commercially available as E-60 supplied by Arjay Equipment Corp., Winston-Salem, N.C. Other exemplary tow processing units have been commercially available as AF-2, AF-3, and AF-4 from Hauni-Werke Korber & Co. KG. In addition, representative manners and methods for operating filter material supply units and filter-making units are set forth in U.S. Pat. No. 4,281,671 to Byrne; U.S. Pat. No. 4,862,905 to Green, Jr. et al.; U.S. Pat. No. 5,060,664 to Siems et al.; U.S. Pat. No. 5,387,285 to Rivers; and U.S. Pat. No. 7,074,170 to Lanier, Jr. et al. Other types of technologies for supplying filter materials to a filter rod-forming unit are set forth in U.S. Pat. No. 4,807,809 to Pryor et al. and U.S. Pat. No. 5,025,814 to Raker; which are incorporated herein by reference.

Filter elements of the present invention may be incorporated within the types of cigarettes set forth in U.S. Pat. No. 4,756,318 to Clearman et al.; U.S. Pat. No. 4,714,082 to Banerjee et al.; U.S. Pat. No. 4,771,795 to White et al.; U.S. Pat. No. 4,793,365 to Sensabaugh et al.; U.S. Pat. No. 4,989,619 to Clearman et al.; U.S. Pat. No. 4,917,128 to Clearman et al.; U.S. Pat. No. 4,961,438 to Korte; U.S. Pat. No. 4,966,171 to Serrano et al.; U.S. Pat. No. 4,969,476 to Bale et al.; U.S. Pat. No. 4,991,606 to Serrano et al.; U.S. Pat. No. 5,020,548 to Farrier et al.; U.S. Pat. No. 5,027,836 to Shannon et al.; U.S. Pat. No. 5,033,483 to Clearman et al.; U.S. Pat. No. 5,040,551 to Schlatter et al.; U.S. Pat. No. 5,050,621 to Creighton et al.; U.S. Pat. No. 5,052,413 to Baker et al.; U.S. Pat. No. 5,065,776 to Lawson; U.S. Pat. No. 5,076,296 to Nystrom et al.; U.S. Pat. No. 5,076,297 to Farrier et al.; U.S. Pat. No. 5,099,861 to Clearman et al.; U.S. Pat. No. 5,105,835 to Drewett et al.; U.S. Pat. No. 5,105,837 to Barnes et al.; U.S. Pat. No. 5,115,820 to Hauser et al.; U.S. Pat. No. 5,148,821 to Best et al.; U.S. Pat. No. 5,159,940 to Hayward et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,240,014 to Deevi et al.; U.S. Pat. No. 5,240,016 to Nichols et al.; U.S. Pat. No. 5,345,955 to Clearman et al.; U.S. Pat. No. 5,396,911 to Casey, III et al.; U.S. Pat. No. 5,551,451 to Riggs et al.; U.S. Pat. No. 5,595,577 to Bensalem et al.; U.S. Pat. No. 5,727,571 to Meiring et al.; U.S. Pat. No. 5,819,751 to Barnes et al.; U.S. Pat. No. 6,089,857 to Matsuura et al.; U.S. Pat. No. 6,095,152 to Beven et al; and U.S. Pat. No. 6,578,584 to Beven; which are incorporated herein by reference. Still further, filter elements of the present invention may be incorporated within the types of cigarettes that have been commercially marketed under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000); and U.S. patent application Ser. No. 12/859,494, filed Aug. 19, 2010; which are incorporated herein by reference.

Filter elements of the various embodiments of the present disclosure may include multiple filter segments. Each segment may have varying properties and may include various materials capable of filtration or adsorption of particulate matter and/or vapor phase compounds.

In one embodiment, a smokable article may include a filter element. The filter element may have a filter segment including a filter material. The filter material may include a fibrous substrate material. For example, the filter material may include cellulose acetate tow prepared as described herein. Alternatively, the filter material may include any other suitable material described herein, including a biodegradable material. Exemplary biodegradable materials are described in U.S. patent application Ser. No. 12/917,171, filed Nov. 1, 2010; Ser. No. 12/963,275, filed Dec. 8, 2010; and Ser. No. 12/827,618, filed Jun. 30, 2010, which are incorporated herein by reference.

Suitable biodegradable materials may include, for example, starch, cellulosic or other organic plant-derived fibrous materials (e.g., cotton, wool, cedar, hemp, bamboo, kapok, or flax), polyvinyl alcohol, aliphatic polyesters, aliphatic polyurethanes, cis-polyisoprene, cis-polybutadiene, polyhydroxy alkanoates, polyanhydrides, and copolymers and blends thereof. Exemplary aliphatic polyesters may include, for example, polyglycolic acid (PGA), polylactic acid (PLA) (e.g., poly(L-lactic acid) or poly(DL-lactic acid)), polyhydroxy butyrate (PHB), polyhydroxy valerate (PHV), polycaprolactone (PCL), and copolymers thereof. In other words, the filter material may include any fibrous material suitable for use in a filter element for a smoking article.

The filter material may include a finish composition applied to the filaments thereof during processing of the filaments. The finish composition may include at least one auxiliary agent. The auxiliary agent may be formulated to selectively interact with a specific target component and/or group of target components that may be generated as thermal decomposition products and/or other aerosol products produced during use of the smokable article. The target component may be, for example, a particulate matter, a vapor phase compound, and/or a group of vapor phase compounds. For example, the auxiliary agent may be formulated to selectively interact with one or more of amines, phenols, carbonyls, alcohols, and/or ionic compounds. A desirable selective interaction may include removal of the target component from mainstream aerosol or smoke. A desirable selective interaction also may include reduction in concentration of the target component in the mainstream aerosol or smoke. In other words, the auxiliary agent may be formulated to filter the target component from the mainstream aerosol of the smoking article by removing and/or reducing the concentration of the target component in the mainstream aerosol.

The interaction between the auxiliary agent and the target component may take the form of, for example, a chemical reaction, hydrogen bonding, and/or a complex formation type reaction. In this manner, the filter segment may selectively filter (e.g., by capture, removal, absorption, and/or adsorption) the target component from the mainstream smoke generated by the smoking article to modify the physical and/or chemical properties of the smoke. In other words, the fiber finish composition may be formulated to selectively interact with the target component of the mainstream smoke such that the filter segment may filter the target component from the smoke that passes through the filter segment. In this manner, the sensory properties of the smoke may be modified to provide a desirable smoking experience for a smoker.

In another embodiment, the filter element may be configured as a multi-segmented filter element having two filter segments. A first filter segment may include a filter material having filaments finished (i.e. coated) with a first finish composition. The first finish composition may primarily consist of and/or may include a first auxiliary agent selected or formulated to selectively interact with a first target component of the mainstream smoke. A second filter segment may include a filter material having filaments finished with a second finish composition. The second finish composition may primarily consist of and/or may include a second auxiliary agent selected to selectively interact with a second target component of the mainstream smoke. The first and second filter segments may be arranged in an end-to-end relationship with one another to form the filter element as described herein. Alternatively, the first and second filter segments may be arranged in a concentric relationship relative to one another. Exemplary concentric filter arrangements are described in U.S. Pat. No. 5,568,819 to Gentry et al., which is incorporated herein by reference. As the mainstream smoke is drawn through the filter element by the smoker, the first and second filter segments may selectively filter the first and second components, respectively, of the smoke. In this manner, the physical and/or chemical properties of the smoke received within the mouth of the smoker (i.e. the smoke having passed through the filter element) may be modified as desired.

The first and second filter segments may include filter materials having a common filament. In other words, the first and second filter segments may be formed from the same fibrous substrate material. For example, the filter materials of both the first filter segment and the second filter segment may include plasticized cellulose acetate filaments. The first and second filter segments also may include distinct finish compositions. For example, the first finish composition of the first filter segment may have a different chemical composition than the chemical composition of the second finish composition of the second filter segment. In this manner, the first and second filter segments may be configured to selectively filter at least two different target components from the mainstream smoke. In other words, the distinct first and second finish compositions may be applied to the common fibrous substrate material to produce first and second filter segments having distinct surface chemistries. In this manner, each of the first and second filter segments may be configured to selectively interact with a different target component of the mainstream smoke. The ability to use a common filament to produce filter segments having different surface chemistries may be desirable. Additionally, the ability to use traditional cellulose acetate filaments to produce filter segments having different surface chemistries capable of selectively filtering the mainstream smoke may be desirable. For example, employing traditional cellulose acetate filaments may allow the production of smoking articles incorporating the filter elements of the present disclosure using traditional processing equipment such as solution-spinning equipment, tow processing equipment, rod-forming units, and/or rod handling devices; and/or materials such as plasticizers, flavorants, and/or other additives.

The first and second filter segments may include finish compositions having auxiliary agents that generally may be considered incompatible with one another or otherwise may not be combinable with one another within a single filter segment. For example, the first and second filter segments may include auxiliary agents that may react with one another (e.g., an acid and a base) when combined during processing and/or within a single filter segment. Such incompatible auxiliary agents may be segregated from one another, for example, by confining each auxiliary agent to a separate filter segment. To that end, the first finish composition of the first filter segment may contain a first auxiliary agent to be segregated from a second auxiliary agent of the second finish composition of the second filter segment. The first and second filter segments may be in abutting contact with one another. Alternatively, the first and second filter segments may be separated from one another by a physical barrier (e.g., a monolayer or multilayer membrane) and/or a gap (e.g., open air-space). The first and second finish compositions may be formulated such that the first and second auxiliary agents may not migrate within the first filter segment and/or the second filter segment. Additionally, or alternatively, the first and second finish compositions may be formulated such that the first and second auxiliary agents may not migrate between the first and second filter segments. In this manner, each of the first and second auxiliary agents may be confined to a single filter segment of the filter element.

Alternative embodiments incorporating multi-segmented filter elements may include any number of filter segments. For example, a filter element may be configured as a multi-segmented filter element having two, three, four, or more filter segments. Each filter segment may be formulated to selectively filter at least one target component from the mainstream smoke of a smoking article to modify the physical and/or chemical properties of the smoke. Such alternative embodiments are contemplated by and within the scope of this disclosure.

Various embodiments of the present disclosure may include a filter material incorporating at least one biodegradable fiber. The biodegradable fiber may be coated with cellulose acetate and/or plasticized cellulose acetate. The surface chemistry of a coated biodegradable fiber may approximate the surface chemistry of a traditional cellulose acetate fiber for use in the filter element of a smoking article. Exemplary materials and/or coatings are described in U.S. patent application Ser. Nos. 12/917,171, filed Nov. 1, 2010; Ser. No. 12/963,275, filed Dec. 8, 2010; and Ser. No. 12/827,618, filed Jun. 30, 2010, each of which is incorporated herein by reference. A finish composition may be applied to the biodegradable fiber filament during processing as described herein such that a filter segment including the biodegradable fiber may be configured to selectively filter a target component of the mainstream smoke generated by the smoking article. Such a filter segment may exhibit an increased degradation rate (e.g., in a disposal environment) as compared to a filter segment formed from traditional cellulose acetate tow. Such a filter segment may be capable both of accelerated degradation and selective filtration of mainstream smoke.

Preferred cigarettes of the present invention will exhibit desirable resistance to draw. For example, an exemplary cigarette may exhibit a pressure drop of between about 50 and about 200 mm water pressure drop at 17.5 cc/sec. air flow. Preferred cigarettes may exhibit pressure drop values of between about 60 mm and about 180 mm, more preferably between about 70 mm and about 150 mm, water pressure drop at 17.5 cc/sec. air flow. Typically, pressure drop values of cigarettes are measured using a Filtrona Cigarette Test Station (CTS Series) available from Filtrona Instruments and Automation Ltd.

Those of skill in the art will appreciate that embodiments not expressly illustrated herein may be practiced within the scope of the present disclosure, including that features described herein for different embodiments may be combined with each other and/or with currently-known or future-developed technologies while remaining within the scope of the claims presented herein. It is therefore intended that the foregoing detailed description be regarded as illustrative rather than limiting. And, it should be understood that the following claims, including all equivalents, are intended to define the spirit and scope of this invention. Furthermore, the advantages described above are not necessarily the only advantages of the invention, and it is not necessarily expected that all of the described advantages will be achieved with every embodiment of the invention.

We claim:

1. A filter element configured for use in a smoking article, the filter element comprising:

a first filter segment comprising a fibrous material that includes at least one first fiber finish composition on fibers of the fibrous material, which first fiber finish composition selectively binds to and thereby filters at least one first target vapor phase component of mainstream aerosol;

a second filter segment comprising a second fibrous material that includes at least one second fiber finish composition on fibers of the fibrous material, which second fiber finish composition binds to and thereby selectively filters at least one second target vapor phase component of mainstream aerosol that is different from the at least one first target vapor phase component, where at least the first fiber finish composition, the second fiber finish composition, or both includes one or more of an antistatic agent, a lubricant, an emulsifier, and a thickening agent.

2. The filter element of claim 1, wherein at least one fiber finish composition comprises a compound selected from a group consisting of a cationic polymer having at least one primary amino group, a dienophile, a polymeric diene, an oligomeric diene, a polymer having at least one aliphatic alkane functional group, a polymer having at least one aliphatic alkene functional group, a polymer having at least one aromatic functional group, a transition metal, a polymer having at least one dithiocarbamate functional group, and any combination thereof.

3. The filter element of claim 1, wherein the fibrous material is plasticized cellulose acetate tow.

4. The filter element of claim 1, wherein the fibrous material is selected from a group consisting of starch, cotton, wool, cedar, hemp, bamboo, kapok, flax, polyvinyl alcohol, aliphatic polyester, aliphatic polyurethane, cis-polyisoprene, cis-polybutadiene, polyhydroxy alkanoate, polyanhydride, and any combination or copolymer thereof.

5. The filter element of claim 4, wherein the aliphatic polyester is selected from a group consisting of polyglycolic acid, polylactic acid, polyhydroxy butyrate, polyhydroxy valerate, polycaprolactone, and any combination or copolymer thereof.

6. The filter element of claim 1, wherein at least one target vapor phase component is selected from a group consisting of an amine, a diene, a phenol, a carbonyl, an alcohol, an ionic compound, a hydroxy-benzene, a non-polar hydrocarbon, a nitrogen oxide, and any combination thereof.

7. The filter element of claim 1, wherein the fibrous material of the first filter segment is the same as the fibrous material of the second filter segment.

8. The filter element of claim 1, wherein the fibrous materials of the first and second filter segments comprise plasticized cellulose acetate tow.

9. A smoking article comprising the filter element of claim 1.

* * * * *